United States Patent [19]

Saito et al.

[11] Patent Number: 4,646,549

[45] Date of Patent: Mar. 3, 1987

[54] APPARATUS FOR ROLLING A CYLINDRICAL BLANK

[75] Inventors: Mituo Saito, Toyohashi; Hidetoshi Hara, Shinshiro; Hideto Hanada, Aichi, all of Japan

[73] Assignees: OSG Mfg. Co.; N.H.K. Builder Co., Ltd.; OSG Corporation, all of Aichi, Japan

[21] Appl. No.: 589,274

[22] Filed: Mar. 12, 1984

[30] Foreign Application Priority Data

Mar. 22, 1983 [JP] Japan ..... 58-47541

[51] Int. Cl.[4] ..... B21H 1/00; B21D 17/04

[52] U.S. Cl. ..... 72/88; 72/95; 72/469

[58] Field of Search ..... 72/88, 90, 469, 73, 72/74, 95, 99, 105

[56] References Cited

U.S. PATENT DOCUMENTS

| | | | |
|---|---|---|---|
| 2,906,147 | 9/1959 | Pelphrey | 72/105 |
| 2,937,547 | 5/1960 | Moeltzner | 72/95 |
| 2,995,964 | 8/1961 | Drader | 72/88 |
| 3,015,243 | 1/1962 | Drader | 72/469 |
| 3,043,169 | 7/1962 | McCardell | 72/84 |
| 3,204,442 | 9/1965 | Wieber | 72/469 |
| 3,677,051 | 7/1972 | Schmidt | 72/95 |
| 4,307,592 | 12/1981 | Krapfenbauer | 72/95 |
| 4,463,588 | 8/1984 | Greis | 72/95 |

FOREIGN PATENT DOCUMENTS

| | | | |
|---|---|---|---|
| 1013611 | 8/1957 | Fed. Rep. of Germany | 72/95 |
| 1294912 | 7/1964 | Fed. Rep. of Germany | 72/95 |
| 617796 | 2/1927 | France | 72/74 |
| 1075723 | 7/1967 | United Kingdom | 72/88 |

*Primary Examiner*—Daniel C. Crane

*Attorney, Agent, or Firm*—Browdy and Neimark

[57] ABSTRACT

Method and apparatus for rolling a cylindrical blank in pressed contact with shaped rolling or die faces of rolling dies to generate, on the periphery of the blank, plural teeth corresponding to a profile of the die faces of the dies. The blank is rolled bidirectionally on the die faces of the dies, first in one of opposite directions and subsequently in the other direction. The blank is fed along its axis of rolling while it is rolled bidirectionally, to push the same between the dies for axially progressive rolling engagement thereof with the die faces. The rolling dies may be of reciprocating flat type or rotating cylindrical type. The feeding motion of the blank may be temporarily stopped upon a temporary stop of the rolling movements of the blank at the end of a first movement thereof in one of the opposite directions.

4 Claims, 28 Drawing Figures

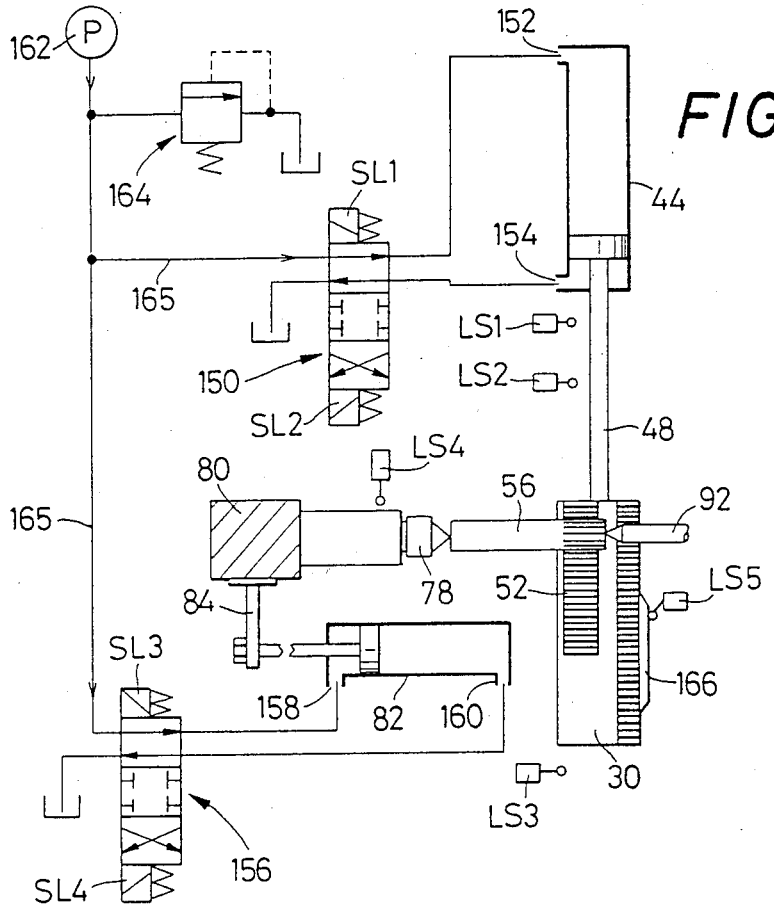
FIG. 21
FIG. 22
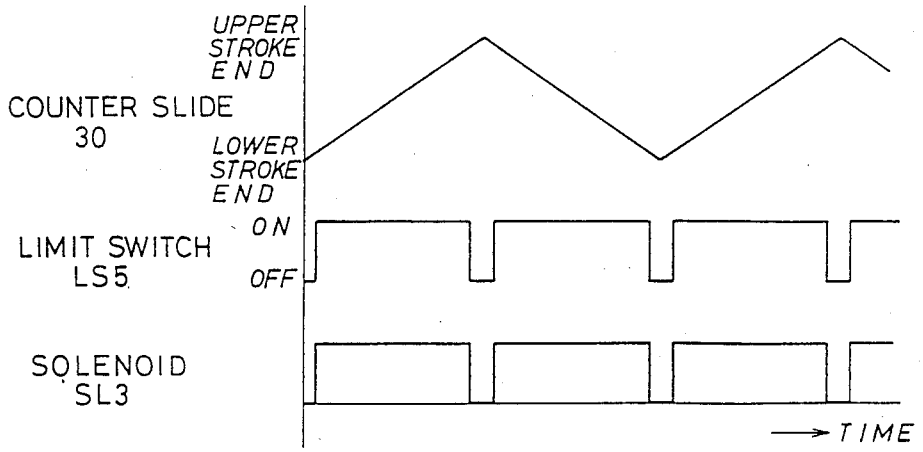

APPARATUS FOR ROLLING A CYLINDRICAL BLANK

BACKGROUND OF THE INVENTION

1. Field of Art

The present invention relates to rolling method and apparatus, and more particularly to a rolling technology which assures a symmetrical cross sectional shape of each of successive projections which are defined by crests and roots formed on a rolled blank, and which particularly assures a cross sectional symmetry of each crest of such projections or teeth generated on a cylindrical blank.

2. Description of the Prior Art

In the art of generating various forms such as projections, teeth, splines and serrations on the periphery of a blank, a rolling process is known, wherein the blank is rolled on the periphery of shaped rolling dies while the rolling faces of the dies are held in pressed contact with the peripheral surface of the blank, whereby projections or teeth consisting of crests and roots corresponding to a desired form to be obtained on an end product is formed on the periphery of the blank. In such a rolling operation, the crests and roots are formed such that the corresponding teeth of the dies penetrate the blank and displace the material to form the roots of the projections to be obtained, and then the displaced material between the roots is forced radially outward to form the crests of the projections. While each of the crests is formed, the material is displaced under pressed sliding actions between the faces of the crest and the mating faces of the die tooth, and flows along those faces in the rolling direction in order to form the crest into a desired final shape (tooth form) in cross section across the axis of the blank.

It is recognized that the direction and amount of flow of the material are determined by the direction of sliding action of the die tooth on the faces of the crest and by the surface pressure between the mating faces of the die tooth and the crest. In the conventional rolling method, however, a blank is rolled in one direction only, i.e., rolled unidirectionally, and therefore there arise differences in the sliding direction and surface pressure between the right and left faces of the die tooth and of the crest being formed on the periphery of the blank. This unevenness in sliding direction and surface pressure causes a problem that each of the crests formed on the blank isnot symmetrical in cross section (cross sectional profile) taken in a plane across the axis of the blank. In general, most of the blank material displaced by the teeth of rolling dies tend to flow radially outwardly along the faces of a crest being formed on the blank, due to sliding contact under pressure between the faces of each die tooth and the corresponding faces of the crest, thus causing shoulder portions or edges of a top land of the crest to radially outwardly protrude from the top land. According to the conventional unidirectional rolling method, the formation of such a radial protrusion occurs in greater amount at one of the shoulder portions adjacent to one edge of the top land, than at the other shoulder portion, and this greater protrusion in the form of burrs must be removed in a subsequent finishing process during or after a rolling cycle, which finishing process is troublesome. Alternatively, an attempt has been made to press such burrs onto the top land of the crest to re-form the crest. In this instance, a product having rolled peripheral teeth with such re-formed crests is unsatisfactry in accuracy and strength.

The above indicated inconveniences experienced in the prior art rolling will be aggravated as the amount of displacement of the blank material is increased, that is, as the number of teeth (projections) to be formed on the blank is reduced or as the depth of the teeth is increased.

As a result of various researches and studies in view of the above background, inventors of the present invention have rejected a common recognition in the prior art that rolling dies located opposite to each other with a given distance therebetween are not allowed to stop their relative movements (rolling action of a cylindrical blank) during a rolling cycle, and that the rolling cycle must be completed during one relative movement of one die to the other in one direction. More particularly, the inventors have found a fact that a cross sectional profile of each tooth form to be generated on the periphery of the blank is improved by reciprocating the rolling dies relative to each other in opposite directions and concurrently feeding the blank axially to push the same from its one end between the rolling dies. The present invention was developed based on the above recognition and knowledge.

SUMMARY OF THE INVENTION

It is accordingly an object of the present invention to provide improved rolling method and apparatus for rolling a cylindrical blank.

Another object of the invention is to provide such improved rolling method and apparatus which permit symmetry in cross section of each of successive projections or teeth defined by crests and roots formed on the rolled blank, and which permits, in particular, formation of a symmetrical cross sectional profile of each crest of the projections or teeth.

According to the present invention, there is provided a method of rolling a cylindrical blank in pressed contact with shaped rolling faces of rolling dies to generate, on the periphery of the blank, plural teeth corresponding to a profile of the rolling faces of the dies. This rolling method comprises the steps of:

rolling the cylindrical blank bidirectionally on the rolling faces on the dies, in opposite directions alternately; and feeding the cylindrical blank along its axis of rolling while it is rolled bidirectionally, to push the same between the dies for axially progressive rolling engagement thereof with the rolling faces.

According to the rolling method of the invention described above, wherein the blank is rolled bidirectionally or rotated in opposite directions, a uniform surface pressure is established on both right and left sides of each projection or tooth (crest of each tooth) being formed, that is, a surface pressure between the right face of the projection and the corresponding right face of the rolling die tooth is equal to that between the left faces of the projection and die tooth, whereby each projection or crest of tooth to be formed on the blank is made symmetrical in cross section across the axis of the blank, and improved in accuracy in the cross sectional shape. Since both shoulder portions adjacent to edges of a top land of each crest are formed symmetrically with each other, the amount of radial protrusion at those shoulder portions is held to a minimum. Consequently, it is possible to use a rolled product without having to conduct a step of removing such protrusions or burrs, or pressing the same onto the top land of the tooth crest to re-form the crest. Further, the absence of such burrs pressed onto the top land will contribute to improvements in accuracy and strength of the product. Another benefit arising from the arrangement of the invention is the minimization of an error (lead error) of the projections (teeth trace) in the axial direction of the blank which is bidirectionally rolled.

According to the invention, there is also provided a rolling apparatus of flat-die type suitable for practicing the rolling method of the invention for rolling a cylindrical blank to generate plural teeth on the periphery of the blank. This rolling apparatus comprises:

a pair of flat dies disposed opposite to each other with a predetermined distance therebetween and movable relative to and in parallel to each other, the flat dies having shaped rolling faces of a profile corresponding to a tooth form of the plural teeth, said predetermined distance being selected to permit the cylindrical blank to be brought into pressed rolling engagement with the rolling faces of the flat dies;

a work supporting device for supporting the blank rotatably about its axis and so that this axis is perpendicular to a line of movements of the flat dies and parallel to planes of the rolling faces, the work supporting device being movable in a direction parallel to said axis of the blank;

a work in-feeding device for driving the work supporting device to feed the blank axially and push the same between said dies for axially progressive rolling engagement thereof with the rolling faces of the dies; and a flat-die reciprocating device for reciprocating the flat dies relative to each other in opposite directions to roll the blank bidirectionally on the rolling faces of the flat dies and in pressed rolling engagement with the rolling faces.

According to the flat-die rolling apparatus constructed as described above, wherein the blank is rolled bidirectionally while it is fed and pushed between the flat dies, the following various advantages are obtained in addition to the advantages previously stated in connection with the rolling method of the invention, that is, the rolling apparatus of the invention provides the following advantages over the known flat-die rolling apparatus:

(1) The required length of the flat dies is at least one-half of the circumference of the outside circle of teeth to be formed on the blank. This means that comparatively short flat dies may be used to roll a blank having a relatively large diameter. Accordingly, the die cost is considerably reduced, and the rolling apparatus may be small-sized.

(2) Since the blank is progressively rolled while it is axially fed across the length of the reciprocating flat dies, a high surface pressure may be easily applied to each local area of the blank. This arrangement makes it possible to easily produce an article having a small number of teeth and a large tooth depth. As another advantage, the flat-die rolling apparatus need not be equipped with such a rigid structure for supporting the flat dies, as is required in a conventional flat-die rolling apparatus wherein a high surface pressure is required throughout the entire area of the rolling faces of the dies. Therefore, the apparatus of the invention may be manufactured in small size and at a reduced cost.

(3) Since the blank is axially fed and rolled progressively in its longitudinal direction, the length (axial dimension) of a part of the blank to be rolled is not limited by the specific width of the die faces.

(4) As long as the module, pressure angle and addendum modification coefficient of teeth to be formed on the blank are constant, the number of teeth to be formed may be varied with ease by adjusting the distance between the flat dies.

While various terms such as "projections", "teeth", "splines", "serrations", "crests" and "roots" have been used in the preceding portion of the specification, those terms are applicable to shapes, forms or profiles of both rolling dies (more particularly, rolling faces thereof) and forms to be generated on the periphery of a rolled blank. In the following portion of the specification, however, the terms "teeth" or "tooth" are used to represent forms on the shaped dies as well as forms to be generated on a blank.

BRIEF DESCRIPTION OF THE DRAWINGS

The above and other objects, features and advantages of the present invention will become more apparent from reading the following description of the preferred embodiments taken in connection with the accompanying drawings in which:

FIG. 21 is a schematic diagram showing a hydraulic circuit and position sensors used for a further embodiment of the invention;

FIG. 22 is a diagrammatic timing chart representing an operation of the arrangement of FIGS. 21 and 23;

DETAILED DESCRIPTION OF THE PREFERRED EMBODIMENTS

The present invention will be described in detail with reference to the accompanying drawings showing several embodiments of the present invention.

Figure 1:
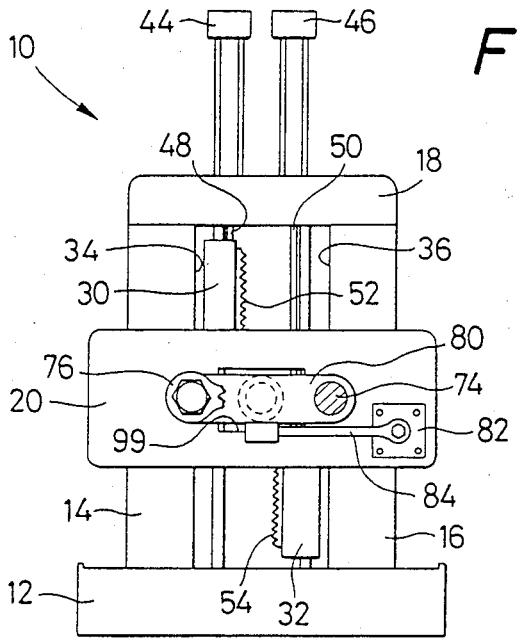
FIG. 1 is a partly cut-away elevational view of one embodiment of a rolling apparatus of the present invention.
Figure 2:
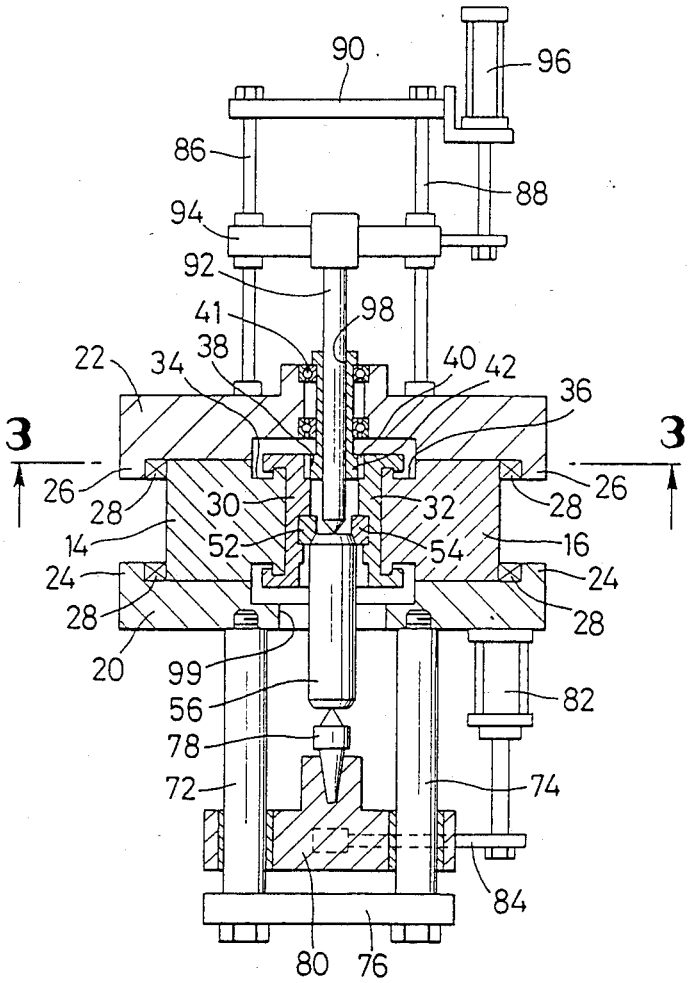

FIGS. 1 and 2 show a reciprocating flat-die type rolling apparatus 10 wherein a pair of slide columns 14, 16 having an extremely high rigidity are disposed upright on a base 12. These slide columns 14, 16 are connected, at their upper ends, to each other by a connecting frame 18. A pair of tie bars, that is, a front tie bar 20 and a rear tie bar 22 are fixed to the longitudinally middle portions of the slide columns 14, 16 with bolts not shown, such that the tie bars 20, 22 are disposed opposite to each other to sandwich the slide columns 14, 16 therebetween. These front and rear tie bars 20, 22 serve to prevent the middle portions of the slide columns 14, 16 from deflecting or being displaced away from each other. More specifically described, the tie bars 20, 22 are formed at their ends with holder portions 24 and 26, respectively, which protrude toward each other. The tie bars 20, 22 are provided with pre-loading devices 28 which are interposed between the outer side surface of the slide column 14 and the holder portions 24, 26, and between the outer side surface of the slide column 16 and the holder portions 24, 26. The front and rear tie bars 20, 22 with the above construction protect the slide columns 14, 16 against their tendencies of deflection at their middle portions away from each other under reaction forces to be developed during a rolling process. Each of the pre-loading devices 28 consists of tightening screws (not shown), and a wedge or gib device (not shown) operable by turning the tightening screws to enlarge an otherwise existing clearance between the slide column 14, 16 and the holder portion 24, 26. The pre-loading devices 28 apply a pre-load to the slide columns 14, 16 in opposite directions toward each other so as to facilitate alignments of flat dies 52 and 54 with respect to a workpiece or blank 56 discussed later, as well as to maintain a rigidity of the slide columns 14, 16.

On the opposite inner side surfaces of the slide columns 14, 16, there are disposed a pair of counter slides 30, 32, respectively, so that they are longitudinally movable. The counter slides 30, 32 are generally C-shaped in cross section, and held at their rear surfaces in sliding contact with the respective opposite inner side surfaces of the slide columns 14, 16. The opposite ends of the C-shape in cross section of the counter slides 30, 32 are placed in engagement with respective pairs of grooves 34, 36 formed in the lateral side surfaces of the slide columns 14, 16. On rear end portions (as viewed with respect to the rolling apparatus 10) of the opposite inner surfaces of the counter slides 30, 32, there are formed opposed timing racks 38, 40 also shown in FIG. 3, running along substantially the entire lengths of the counter slides 30, 32. The timing racks 38, 40 are held in mesh with a synchronizer or timing gear 42 which is rotatably supported in bearings 41 disposed in the middle portion of the rear tie bar 22. The upper ends of the counter slides 30, 32 are respectively connected to piston rods 48, 50 of a pair of hydraulic cylinders 44, 46 which are fixed to the connecting frame 18. Thus, the counter slides 30, 32 are reciprocated, by the hydraulic cylinders 44, 46, relative to each other between their positions shown in solid line and broken phantom line in FIG. 4, such that accurate relative positions of the counter slides 30, 32 are maintained. The pair of flat dies 52, 54 are supported on the longitudinally upper and lower portions of the counter slides 30, 32, respectively, so that a distance between the opposed dies 52, 54 is slightly smaller than the diameter of the cylindrical blank 56, which is supported rotatably about its longitudinal axis. Upon reciprocating movements of the counter slides 30, 32, the opposed flat dies 52, 54 are pressed against the periphery of the blank 56, whereby a rolling operation is effected. Thus, the hydraulic cylinders 44 and 46 constitute a flat-die reciprocating actuator or device for driving the flat dies 52 and 54 in a reciprocatory manner.

The front and rear tie bars 20, 22 are provided with a work supporting device to rotatably support the blank 56 so that the axis of rotation of the blank 56 is perpendicular to the direction of reciprocation of the flat dies 52, 54 and parallel to the die faces (more precisely, the inner opposite surfaces of the counter slides 30, 32 to which the flat dies 52, 54 are attached). The work supporting device also functions to in-feed or move endwise the blank 56 along its axis of rotation. Stated in more detail, the front tie bar 20 is equipped with a pair of guide rods 72, 74 which extend toward the front of the apparatus 10 in a direction perpendicular to the direction of reciprocation of the flat dies 52, 54 and parallel to the opposite surfaces of the counter slides 30, 32, that is, in a direction parallel to the axis of rotation of the blank 56. The guide rods 72, 74 are connected at their free ends to each other by a connecting plate 76. The guide rods 72, 74 extend through an in-feed slide 80 so that the latter is moved and guided along the length of the former. The in-feed slide 80 includes a live or revolving center 78 having an axis which extends in the middle of the distance between the flat dies 72 and 74 and in parallel to the guide rods 72, 74. The in-feed slide 80 is connected via a drive bar 84 to a piston rod of a hydraulic cylinder 82 which is provided in fixed relation with the front tie bar 20 as a work in-feeding device, whereby the in-feed slide 80 is movable toward the front tie bar 20.

On the other hand, the rear tie bar 22 is equipped with a pair of guide rods 86, 88 which extend toward the rear of the apparatus 10 in a direction parallel to the axis of rotation of the blank 56. The guide rods 86, 88 are connected at their free ends to each other by a connecting plate 90. The guide rods 86, 88 extend through a work support slide 94 including a dead center 92 which extends toward and concentrically with the revolving center 78, so that the work support slide 94 is moved and guided along the guide rods 86, 88. The work support slide 94 is connected to a piston rod of a small-sized hydraulic cylinder 96 fixed to the connecting plate 90, and normally biased by the cylinder 96 in a direction toward the rear tie bar 22. The center 92 extends through a through-bore 98 concentrically formed through the timing gear 42. The front tie bar 20 is formed with a central through-hole 99 through which the blank 56 is adapted to extend when it is rolled. The revolving or live center 78 cooperates with the dead center 92 to hold the blank 56 at its diametric center on the opposite end faces so as to permit the same to be freely rotated about its axis. Further, upon actuation of the hydraulic cylinder 82, the blank 56 is continuously pressed, at its trailing end, to pass between the flat dies 52, 54, for axially progressive rolling engagement with the rolling faces of the dies 52, 54, beginning at the leading end. Thus, the in-feed slide 80 carrying the live center 78, the work support slide 94 carrying the dead center 92, and the small-sized hydraulic cylinder 96 constitute the previously indicated work supporting device. In this connection, it is noted that the hydraulic cylinder 96, which serves to exert a biasing force to the blank 56 to hold the same between the live center 78 and the center 92, may be replaced by other similar means for producing a biasing force, such as pneumatic cylinders or spring devices.

Figure 5:
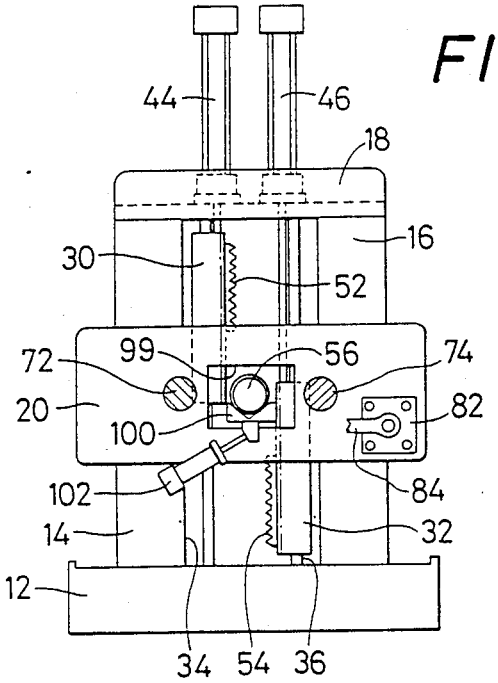
FIG. 5 is an elevational view of the apparatus of FIG. 1, with its guide rods broken away.

The front tie bar 20 is provided with a work rest 100 which is made from a Vee-block as shown in FIG. 5 (not shown in the preceding figures) and slidable via a slide unit not shown. The work rest 100 is adapted to easily establish a radial alignment of the blank 56 with the axes of the centers 78 and 92 when the blank 56 is placed on the rest 100, and to receive the blank 56 after completion of a rolling cycle on the blank 56. A work rest actuating cylinder 102 fixed to the front tie bar 20 is provided to retract the work rest 100 obliquely downwardly while being guided by the slide unit indicated above, so that the work rest 100 will not interfere with the in-feed slide 80 and other members.

To permit the blank 56 to be rolled along its entire circumference, it is required that the length of the flat dies 52, 54 be determined to be equal to or greater than one half of the circumference of the outside or addendum circle of teeth to be formed on the circumference of the blank 56. However, when the die length is selected to be only slightly greater than the above indicated lower limit, a relatively large number of reciprocations of the dies 52, 54 is required to complete a rolling cycle, and the rolling efficiency of the apparatus 10 is accordingly reduced. Conversely, an excessive length of the dies 52, 54 will cause the rolling apparatus 10 to be large-sized and costly. Therefore, it is preferred that the dies be not greater than five times, particularly three times as long as the circumference of the previously stated outside circle. In this specific embodiment, the flat dies 52, 54 have a length slightly smaller than the circumference of the outside circle. Where the blank 56 having a comparatively small diameter is to be rolled on the apparatus 10 which is designed for rolling large-diameter blanks, it is of course possible that the flat dies 52, 54 be five or more times as long as the circumference of the outside circle of teeth to be formed on the blank 56.

Figure 6:
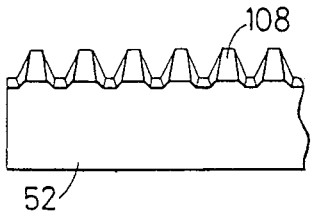
FIGS. 6 and 7 are respectively a fragmentary elevational view of a flat die provided on the apparatus of FIG. 1, and an end elevation view of the flat die of FIG. 6.
Figure 7:
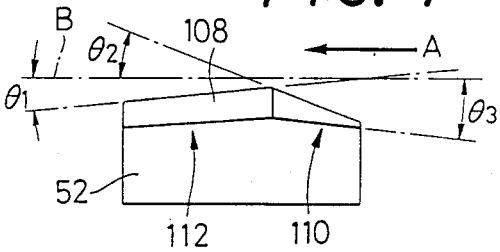
Figure 8:
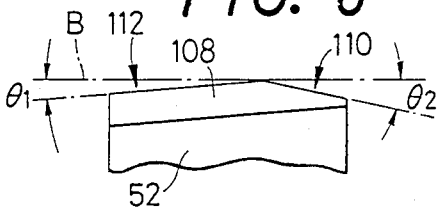
FIGS. 8 through 11 are views corresponding to FIG. 7, showing other forms of a flat die, respectively.
Figure 9:
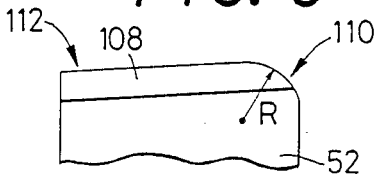
Figure 10:
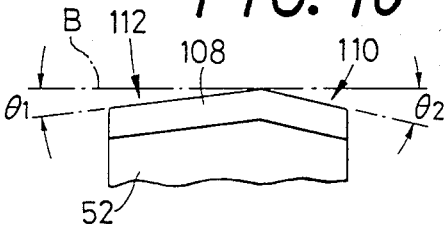
Figure 11:
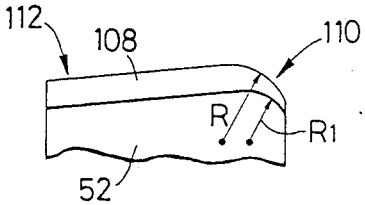

As illustrated in FIG. 6, each of the flat dies 52, 54 has a multiplicity of spaced-apart parallel teeth 108 running along the width of its working or rolling face and having a profile corresponding to a desired tooth form (gear or spline teeth, or similar projections) which is to be generated on the periphery of the blank 56. As shown in FIG. 7, each tooth 108 has a roll-on part (lead-in chamfer) 110 on the blank-incoming or blank-feed-in side, and a roll-off part (relief or run-off part) 112 on the blank-outgoing or blank-feed-out side, both as viewed in a direction along the width of the tooth 108. The roll-off part 112 is inclined at an angle $\theta 1$ with respect to a straight line B parallel to the axis of the blank 56, such that a distance between the opposed rolling die faces (of the two dies 52, 54) is increased in a direction A in which the blank 56 is fed. The roll-off part 112, which has substantially the same tooth depth in a direction along the width of the die 52, 54, serves to re-form a substantially completely generated profile of the rolled blank 56 and finish it to the predetermined final dimensions, and at the same time serves to gradually relieve the blank 56 of an elastic deformation or strain which has been caused in the previous rolling step. The roll-on part 110 is inclined at an angle $\theta 2$ to the line B such that a distance between the opposed die faces is reduced in the blank feeding direction A. The roll-on part 110 is tapered, so that an angle $\theta 3$ of the bottom land to the line B is smaller than the angle $\theta 2$ of the top land to the line B. This configuration allows an easy and enhanced penetration of the die tooth 108 into the leading end of the blank 56, and provides the tooth 108 with an increased strength at its roll-on part 110, thereby prolonging a service life of the flat dies 52, 54. According to the invention, it is also possible to employ flat dies 52, 54 which have teeth as shown in FIGS. 8–10. A tooth form 108 shown in FIG. 8 in cross section taken along the width of the die face, is obtained by first forming a tooth so that its top land is inclined at a suitable angle $\theta 1$ with respect to the line B, and subsequently tapering a blank-incoming part of the tooth at an angle $\theta 2$ to the line B so as to generate a roll-on part 110. A tooth form 108 shown in FIG. 9 is provided with a roll-on part 110 by rounding a blank feed-in part of the tooth with a radius R. A tooth form 108 shown in FIG. 10 is formed with a roll-on part 110 which has the same tooth depth along the width of the die face. It is observed, however, that the tooth forms 108 of FIGS. 8 and 9 are improved in strength at the roll-on part 110 and characterized by their prolonged service life, but suffer a low ability of penetration into the leading end of the blank 56. On the contrary, the tooth form 108 of FIG. 10 is characterized by extremely high ability of the roll-on part 110 to penetrate into the blank 56 but suffers a low strength and a shorter service life. To meet both of the requirements, i.e., penetration into the blank and service life of the die, therefore, it is very much preferred that the roll-on part 110 be formed so that the angle $\theta 2$ of its top land is larger than the angle $\theta 3$ of its bottom land (root flat) as shown in FIG. 7. In this connection, a tooth form 108 shown in FIG. 11 provides an ability comparable to that obtained by the tooth form 108 of FIG. 7. In this instance of FIG. 11 wherein the blank-incoming part of the tooth is rounded with a radius R to provide the roll-on part 110, the bottom land of the roll-on part 110 is contoured with a radius R1 smaller than the radius R.

The operation of the present embodiment of the rolling apparatus 10 will be hereunder described.

Figure 3:
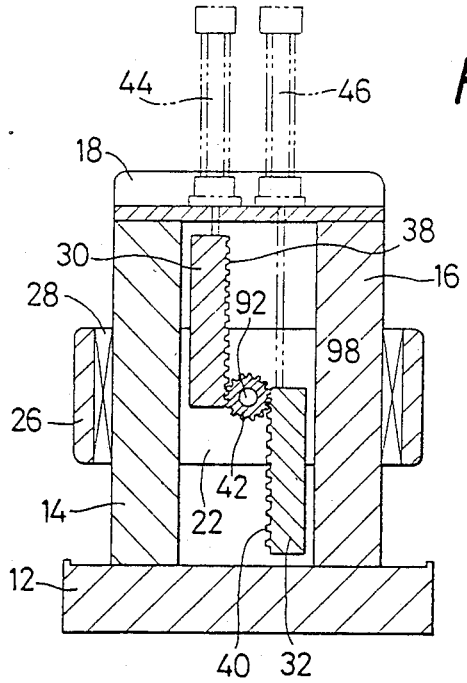
FIGS. 2 and 3 are respectively a plan view in cross section of the apparatus of FIG. 1, and a view of the same apparatus in cross section taken along line 3—3 of FIG. 2.
Figure 4:
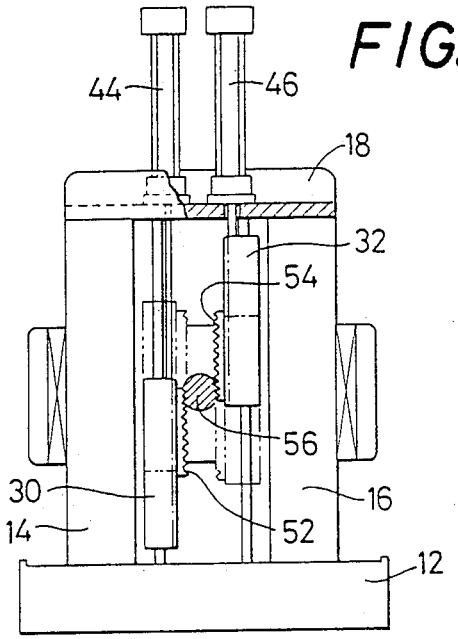
FIG. 4 is an elevational view of the apparatus of FIG. 1 with its front tie bar removed.

While the flat-die type rolling apparatus 10 is at rest, the counter slides 30, 32 are located at their predetermined rest positions by the hydraulic cylinders 44, 46. This condition is illustrated in FIGS. 1, 3 and 5.

When the blank 56 is placed on the work rest 100 and the apparatus 10 is started through an operator's control panel not shown, the hydralic cylinders 82 and 96 are operated according to control commands from a control device not shown, whereby the live and dead centers 78 and 92 are moved toward each other to rotatably support the blank 56 therebetween. The work rest actuating cylinder 102 is then actuated to retract the work rest 100 to a position at which the work rest 100 will not interfere with the in-feed slide 80 and other members.

Upon further operation of the hydraulic cylinder 82, the in-feed slide 80 is moved toward the front tie bar 20 to push the blank 56 until its leading end is inserted between the flat dies 52, 54, as illustrated in FIG. 2. The hydraulic cylinders 44, 46 are actuated by the control device to start the counter slides 30, 32 from their rest positions and cause them to reciprocate between the upper and lower positions shown in solid and phantom lines in FIG. 4. Reciprocating strokes of these counter slides 30, 32 are determined by position sensors (not shown) such as limit switches and photoelectric switches which detect the vertical positions of the slides 30, 32.

Figure 12:
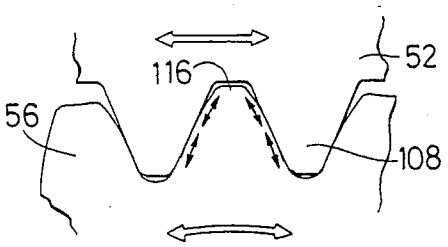
FIG. 12 is a schematic view illustrating a rolling operation on the apparatus of FIG. 1.

When the blank 56 is fed in this condition by the hydraulic cylinder 82 and the periphery of the leading end of the blank 56 is pressed against the flat dies 52, 54, the roll-on parts 110 of the teeth 108 will penetrate the leading end of the blank 56. Consequently, the blank 56 squeezed between the reciprocating flat dies 52, 54 is rotated in alternately opposite directions, that is, the periphery of the blank 56 is rolled on the die faces of the flat dies 52, 54, first in one direction and then in the reverse direction. As the leading end of the blank 56 under rolling action is fed from the roll-on part 110 toward the roll-off part 112, the teeth 108 are pressed against the periphery of the blank 56, whereby the material in the pressed areas of the blank 56 is displaced to form roots of teeth 116 and the displaced material is forced radially outwardly of the blank 56 to form crests of the teeth 116, as shown in FIG. 12. Since the blank 56 is rolled in the opposite directions while the die faces of the reciprocating dies 52, 54 are pressed against the surface of the blank 56, surface pressures between the right and left faces of the tooth 116 and the mating faces of the tooth 108 of the dies, are averaged and made even on both sides of the teeth 116, and the rolling contact between the mating faces is effected in both directions. Hence, the material of the blank 56 which is displaced by the faces of the tooth 108, may evenly flow along the faces of the tooth 116, thus permitting the crest of the tooth 116 to have equal amounts of protrusions adjacent to the ends of the top land of the crest, i.e., permitting formation of a symmetrical crest with identical right and left shoulders, as indicated in FIG. 12.

Figure 13:
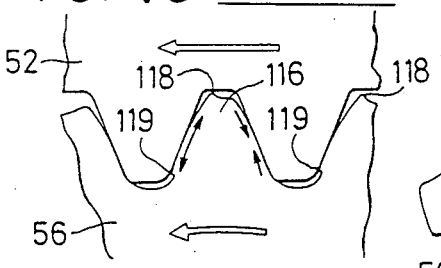
FIG. 13 PRIOR ART
FIG. 13 is a schematic view corresponding to FIG. 12, illustrating a rolling operation on a conventional rolling apparatus.
Figure 16:
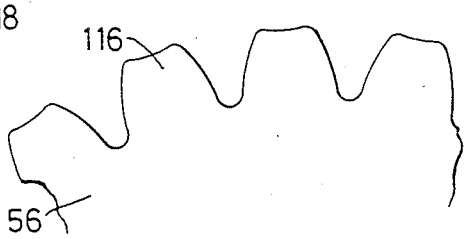
FIG. 16 is a view corresponding to FIG. 15, representing an example of a tooth form obtained on the apparatus of FIG. 1.

This is not the case with a conventional rolling method shown in FIG. 13 wherein the blank 56 is rolled unidirectionally. In the unidirectional rolling of FIG. 13, a surface pressure between the right faces of the die tooth 108 and of the tooth 116 being formed is different from that between the left faces of the teeth 108 and 116, and the rolling direction is different locally. This causes a non-symmetric or unbalanced form of the tooth 116 when the same is formed through displacement and flow of the material of the blank 56 due to rolling thereof at its faces on the mating faces of the tooth 116. In other words, the conventional unidirectional rolling method encounters a risk that a flash 118 in the form of burr is produced appreciably at one of the shoulders of the tooth 116, i.e., at the shoulder located downstream in the rolling direction of the blank 56, and a flash 119 is additionally formed at a position adjacent to one end of the bottom land on the downstream side of the tooth 116. The amount of the flash 118 is increased as the number of teeth of a gear or spline to be generated is decreased (as the module of the gear is increased) and as the tooth depth is increased (as the pressure angle is decreased). Accordingly, the rolled gear of spline must be subjected to a subsequent machining or other finishing process to remove the flashes 118 or press them onto the top land of the teeth 116, before the gear or spline is put into service. Further, the flashes 118 if pressed onto the top land of the teeth 116, and the flashes 119 at the roots of the teeth will affect the strength or accuracy of the teeth 116. Thus, the unidirectional rolling is disadvantageous in many aspects. On the contrary, the instant embodiment of the invention enables the teeth 116 to be formed symmetrically, i.e., permits the right and left shoulder portions of the crest to be formed evenly in radial protrusion. As a result, a minimum flash is produced on or adjacent to the top land of the teeth 116, and the rolled gear or spline may be used without a subsequent finishing process. Thus, the need to press the otherwise produced shoulder burrs or flashes onto the top land of the teeth 116 is eliminated, whereby the teeth 116 is greatly freed from the conventionally experienced disadvantages in strength and accuracy resultant from the flashes.

When the blank 56 has been fed a predetermined distance by the hydraulic cylinder 82 and a rolling operation has been performed on the periphery of the blank 56 along a predetermined length thereof, the inward end of the blank feeding travel is detected by a position sensor not shown, and the counter slides 30, 32 are returned to their original rest positions by the hydraulic cylinders 44, 46. Successively, the small-sized hydraulic cylinder 96 is actuated to move the blank 56 in the reverse direction to its original position, and the work rest actuating cylinder 102 is actuated to move the work rest 100 to its original operative position. Subsequently, the cylinders 96 and 82 are operated to move the live and dead centers 78 and 92 away from each other, and the rolled blank 56 (rolled product) is placed on the work rest 100.

Figure 14:
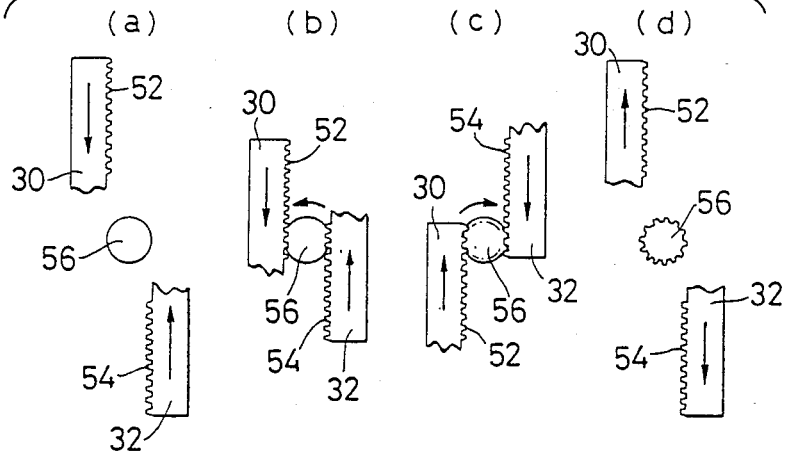
FIG. 14 are illustrations showing a rolling cycle on the apparatus of FIG. 1.

The rolling cycle discussed above is shown in FIG. 14, wherein the flat dies 52, 54, which are located at their rest positions upon starting of a rolling operation as indicated at (a), are reciprocated in opposite directions in parallel to each other and relative to each other to roll the blank 56 in opposite rotational directions on the die or rolling faces of the dies 52, 54 while the blank 56 is fed in its endwise direction parallel to the axis of rotation, between the flat dies 52, 54 with its leading end in pressed rolling engagement with the die faces, as illustrated at (b) and (c). After the reciprocating cycle of the flat dies 52, 54 has been completed, the dies are retracted to their rest positions and the blank 56 is simultaneously returned to the original position, as shown at (d).

Figure 15:
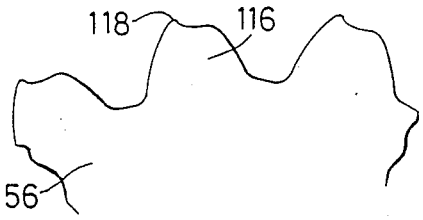
FIG. 15 PRIOR ART
FIG. 15 is a view representing an example of a tooth form obtained on a conventional rolling apparatus.

In the event the blank 56 is rolled unidirectionally according to a conventional method, the tooth 116 formed on the periphery of the blank 56 fails to be symmetrical and tends to have a large flash 118 at one shoulder adjacent to one end of the top land, as depicted in FIG. 15, thereby causing various inconveniences as previously pointed out. In accordance with the instant bidirectional rolling method, however, each of the teeth 116 is formed symmetrically in cross section and an amount of radial outward protrusion at both shoulders of the tooth 116 is held smaller than that in the conventional method. Thus, the instant rolling method eliminates the requirement for a subsequent process of removing flashes or burrs otheriwise produced at the shoulders of the teeth 116. Further, since it becomes unnecessary to press the flashes or burrs at the shoulders onto the top land of the teeth 116, adverse effects of the pressed flashes on the strength and accuracy of the teeth 116 are substantively removed.

The present embodiment wherein the blank 56 is rolled bidirectionally, offers a further advantage that a lead error of the teeth 116 is reduced to a great extent, as compared with a conventional roller-die or cylindrical-die rolling method wherein a blank is rolled in one direction.

Further, the present embodiment of the rolling apparatus provides the following different advantages over the known flat-die rolling apparatus:

(1) The required length of the flat dies 52, 54 is at least one-half of the circumference of the outside circle of teeth to be obtained on the blank 56. This means that comparatively short flat dies 52, 54 may be used for rolling a blank 56 with a relatively large diameter. Accordingly, the die cost is considerably reduced, and the rolling apparatus 10 may be small-sized.

(2) Since the blank 56 is progressively rolled while it is axially fed across the length of the reciprocating flat dies 52, 54, a high surface pressure may be easily applied to each local area of the blank 56. This method makes it possible to easily produce an article having a small number of teeth and a large tooth depth. As another advantage of the method, the flat-die rolling apparatus 10 need not be equipped with a highly rigid structure for supporting the flat dies 52, 54, and therefore may be manufactured in small size and at a reduced cost.

(3) Since the blank 56 is progressively rolled while it is axially fed, the length (axial dimension) of a processed part of the blank is not limited by the specific width of the flat dies 52, 54.

(4) As long as the module, pressure angle and addendum modification coefficient of teeth to be formed on the blank 56 are constant, the number of teeth to be formed may be varied with ease by adjusting the distance between the flat dies 52, 54.

Other embodiments of the invention will be described below. The same reference characters will be used to identify components of these embodiments corresponding to those of the preceding embodiment, and the description of the corresponding components is omitted.

Figure 17:
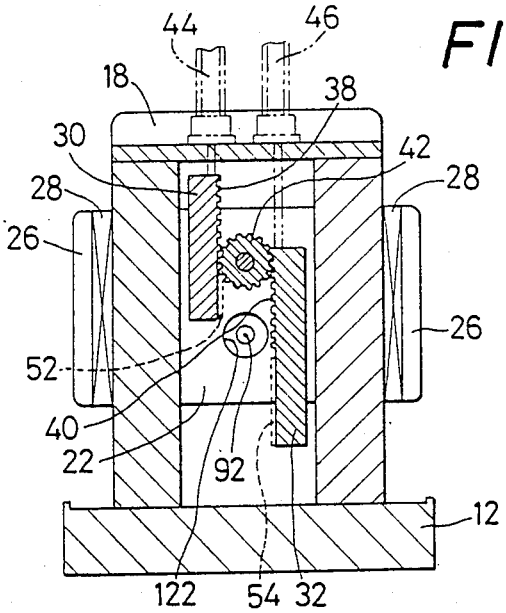
FIGS. 17 and 18 are cross sectional views corresponding to FIGS. 3 and 2, respectively, illustrating other embodiments of the present invention.
Figure 18:
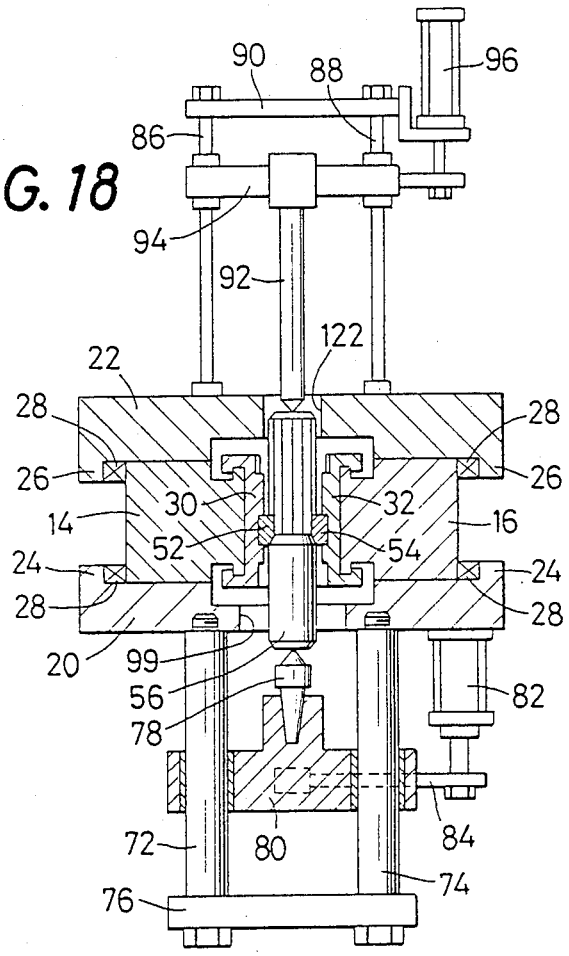

An embodiment shown in FIGS. 17 and 18 is characterized and different from the preceding embodiment in that the axis of rotation of the timing gear 42 is spaced from that of the blank 56 in the vertical direction. Described in more detail, the rear tie bar 22 has a through-hole 122 which is formed concentrically with the axis of the live and dead centers 78 and 92. This through-hole 122 is adapted to allow the blank 56 to pass therethrough. The center 92 may extend through the through-hole 122 to support the blank 56 rotatably about its axis, in cooperation with the live center 78. As the blank 56 is fed during a rolling operation, it may pass through the through-hole 122, i.e., its leading end may extend rearwardly of the through-hole 122. In this arrangement, the diameter of the blank 56, and the length of a part thereof to be rolled are not limited by the through-bore 98 formed through the timing gear 42. In a part of the rear tie bar 22 above the through-hole 122, there is rotatably supported the timing gear 42, which engage the timing racks 38, 40 formed on the counter slides 30, 32, in order to synchronize reciprocating movements and maintain predetermined relative positions of the counter slides 30, 32.

According to this embodiment wherein the through-hole 122 formed in the rear tie bar 22 has a diameter greater than that of the blank 56 to be processed, there is substantially no limitation in the length of a part of the blank 56 along which a rolling operation takes place, this advantage being also provided in the preceding embodiment.

Figure 19:
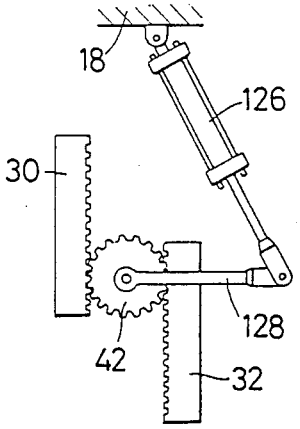
FIGS. 19 and 20 are schematic views showing other forms of flat-die reciprocating devices alternatively usable according to the present invention.
Figure 20:
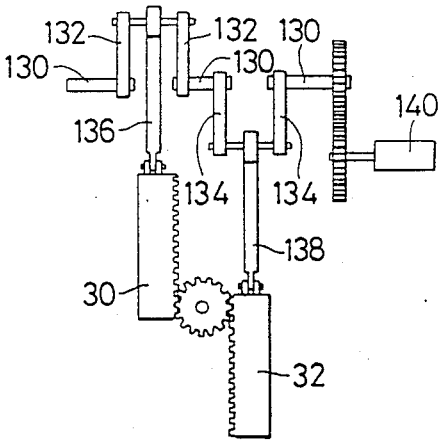

An alternative form of a flat-die reciprocating actuator is shown in FIG. 19, wherein the timing gear 42 engaging the counter slides 30, 32 is driven by a hydraulic cylinder 126. For example, the base of the hydraulic cylinder 126 is pivotably connected to the connecting frame 18, and the end of a rod of the cylinder 126 is pivotably connected to one end of a lever 128 which is fixed to the timing gear 42. Another alternative form of a flat-die reciprocating actuator is illustrated in FIG. 20. This actuator comprises: crank shafts 130 supported as by the connecting frame 18; sets of crank arms 132 and 134 extending the crank shafts 130 with an angular phase difference of 180 degrees; connecting rods 136 and 138 connecting the sets of crank arms 132, 134 to the counter slides 30, 32, respectively; and a motor 140 to drive the crank shafts 130. The counter slides 30, 32 are reciprocated via the rods 136, 138 and crank arms 132, 134 through rotary movements of the crank shafts 130. In this case, the timing gear 42 may be advantageously eliminated because equal reciprocating strokes are mechanically given to the counter slides 30, 32 in opposite directions. It is noted, as another advantage, that the velocity of the counter slides 30, 32 is changed substantially according to a sinusoidal waveform, thus allowing a highly smooth rolling operation.

In all embodiments of rolling apparatus of reciprocating flat-die type described hitherto, the counter slides 30, 32, and consequently the flat dies 52, 54 are temporarily stopped after a first reciprocating movement (first stroke) in one direction and before a second reciprocating movement (second, return stroke) in the other direction. In other words, the rolling movements of the blank 56 are temporarily stopped at the end of a first rotation in one direction which is followed by a second rotation in the reverse direction. In considering that this temporary stop is unavoidable, it is desired to stop the feeding movement of the blank 56 temporarily only while its rolling movement is stopped at the end of the first reciprocating stroke of each flat die 52, 54. If the blank 56 is fed between the rolling faces of the dies 52, 54 while its rolling motion is stopped with the dies located at the end of the first stroke, there is a possibility that the surface of the blank 56 in a rolling cycle may be scratched due to friction with the rolling faces of the dies 52, 54. An example of control means for such temporary stop of the blank in-feeding movement, as applied to the rolling apparatus of FIGS. 1–5, will be described hereunder. However, the description is limited to the manners of controlling reciprocating movements of the flat dies 52, 54 and in-feeding motion of the blank 56.

Referring to FIG. 21, there are schematically shown a hydraulic circuit and position sensors used for controlling the rolling apparatus 10, including a TOOL DRIVE control valve 150. This control valve 150 is a three-position, solenoid-operated, four-way, tandem-center (center-by-pass) valve equipped with two solenoids SL1 and SL2. When the two solenoids SL1, SL2 are both in a deenergized state, a line pressure of the hydraulic system is not applied to any member of the system. Upon energization of the solenoid SL1, the line pressure, i.e., fluid under pressure, is applied to an upper port 152 of the hydraulic cylinder 44 and to a lower port (not shown) of the hydraulic cylinder 46, in order to move the counter slide 30 in a downward direction and the counter slide 32 in an upward direction. When the solenoid SL2 is energized, the line pressure is applied to a lower port 154 of the hydraulic cylinder 44 and to an upper port (not shown) of the hydraulic cylinder 46, whereby the counter slides 30 and 32 are moved upward and downward, respectively. The hydraulic circuit also includes a WORK DRIVE control valve 156 of the same type and structure as the control valve 150. This control valve 156 is equipped with solenoids SL3 and SL4. Upon energization of the solenoid SL3, the line pressure is applied to a first port 158 of the hydraulic cylinder 82 to feed the blank 56 in its axial direction. On the other hand, the energization of the solenoid SL4 will cause the line pressure to be applied to a second port 160 of the hydraulic cylinder 82, thereby retracting the blank 56 from between the flat dies 52, 54. FIG. 21 shows the condition wherein the solenoids SL1 and SL3 are held energized. It is noted, in this connection, that the hydraulic cylinder 96 serves to bias the dead center 92 toward the live center 78 for rotatably supporting the blank 56 by and between the two centers 92, 78. This cylinder 96 is simply actuated by the operator when the blank 56 is installed and removed. For this reason, no further description of the cylinder 96 will be given. The line pressure which is generated by a hydraulic pump 162 and held within a suitable range by means of a relief valve 164, is supplied through conduits 165 to the TOOL DRIVE and WORK DRIVE control valves 150 and 156.

The rolling apparatus 10 is provided with limit switches LS1, LS2, LS3, LS4 and LS5 serving as sensors to detect positions of various movable components. The limit swtich LS1 is to sense the original rest position of the counter slide 30, and the limit switches LS2 and LS3 sense upper and lower ends of reciprocating strokes of the counter slide 30. The limit switch LS4 is for sensing a predetermined inward end of an in-feeding stroke of the work in-feed slide 80, that is, the innermost position of the blank 56. This inward in-feeding stroke end to be detected by the limit switch LS4 is determined depending upon a specific length of that part of the blank 56 on which teeth of a desired profile are formed by rolling, i.e., according to particular kinds of blanks or workpieces to be rolled. The limit switch LS5 is adapted to be actuated by a plate or peripheral cam 166 fixed to the counter slide 30, in order to detect a travel range of the counter slide 30 except slight distances of its movements near the upper and lower ends of the reciprocating strokes, that is, to detect a range of movement shortly after the start and shortly before the stop of each upward or downward reciprocating stroke of the counter slide 30. In other words, the limit switch LS5 is held actuated, as shown in FIG. 22, during a time space shortly after the start of the upward stroke of the counter slide 30 and shortly before the end of the same stroke, and during another time span shortly after the start of the downward stroke and shortly before the end of the same stroke.

Figure 23:
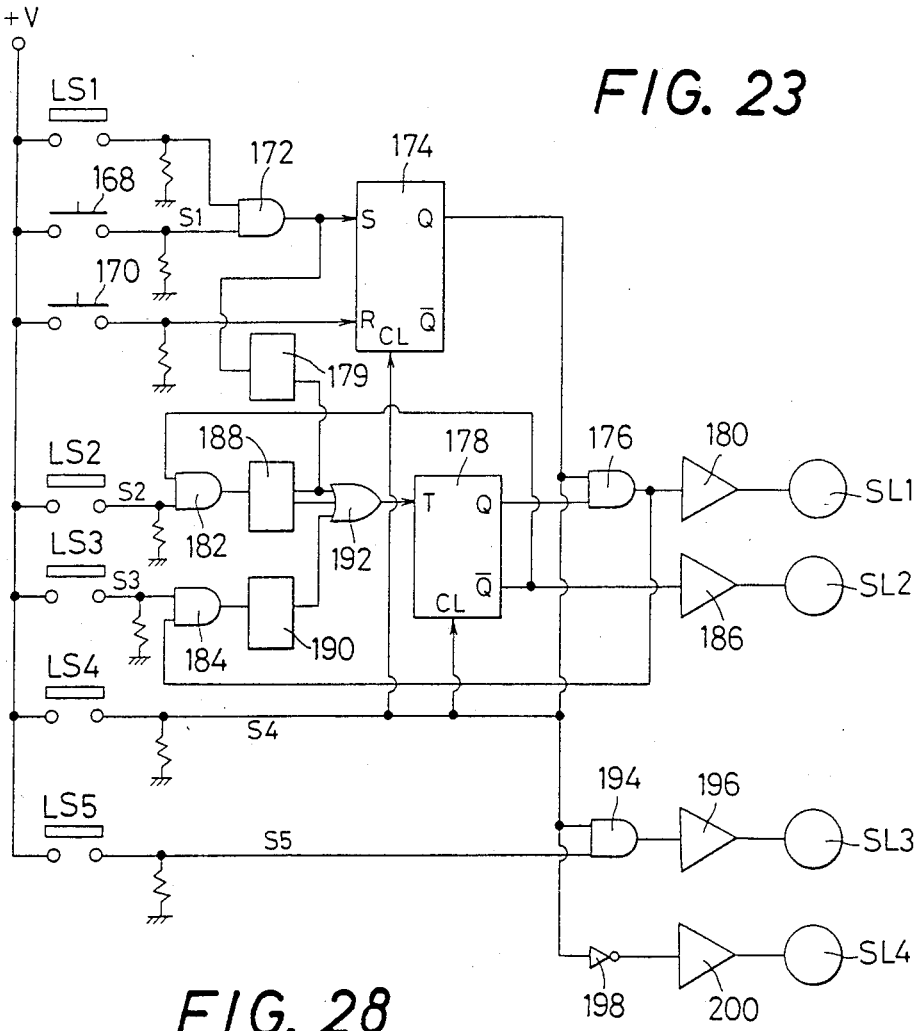
FIG. 23 is a schematic diagram showing a control circuit used in the embodiment of FIG. 21.

There is shown in FIG. 23 an essential part of the control means provided for the rolling apparatus 10. The control means comprises a START switch 168 and a STOP switch 170 both provided as operator-controlled means. An AND gate 172 is open when the limit switch LS1 senses the original rest position of the counter slide 30. Upon depression of the START switch 168 in this condition, a START signal S1 is applied to a set-reset type flip-flop 174, which is in turn placed on its set state. In this set state of the flip-flop 174, an AND gate 176 is open, and a signal representing a set state of a T-type flip-flop 178 may be applied to a solenoid SL1 via a driver circuit 180. In the meantime, the START signal S1 generated upon activation of the START switch 168 is fed to the T-type flip-flop 178 via a one-shot multivibrator circuit 179 and an OR gate 192, whereby the flip-flop 178 is placed in its set state. As a result, the solenoid SL1 is energized to cause the counter slide 30 to move downward and the counter slide 32 to move upward. When power is applied to the instant control means, the T-type flip-flop 178 and the set-reset type flip-flop 174 are automatically reset by a reset circuit not shown, and a signal representing the reset state of these flip-flops 178 is applied to a solenoid SL2 via a driver circuit 186, so that the counter slide 30 is located at its original reset position.

While the counter slide 30 is in its downward reciprocating stroke, the limit switch LS2 may be held energized. However, the AND gate 182 is closed while the counter slide 30 is moving downward, and therefore an UPPER POSITION signal S2 from the limit switch LS2 to represent the upper stroke end of the slide 30 is not applied to the T-type flip-flop 178. When the counter slide 30 has reached its lower stroke end, the limit switch LS3 is energized and a LOWER POSITION signal S3 representing the lower stroke end is generated. Since the AND gate 184 is held open while the counter slide 30 is in its downward stroke, the LOWER POSITION signal S3 is supplied to the T-type flip-flop 178 via the AND gate 184, one-shot multivibrator circuit 190 and OR gate 192. Consequently, the T-type flip-flop 178 is inverted, and a signal representing its reset state is applied to the solenoid SL2 via the driver circuit 186, whereby the TOOL DRIVE control valve 150 is operated to move the counter slide 30 upward and the counter slide 32 downward.

When the counter slide 30 has reached its upper stroke end, the UPPER POSITION signal S2 is generated from the limit switch LS2. Since the AND gate 182 is open during the upward reciprocating stroke of the counter slide 30, the UPPER POSITION signal S2 is applied to the T-type flip-flop 178 via the one-shot multivibrator circuit 188 and OR gate 192, and the flip-flop 178 is restored to its set state. In consequence, the solenoid SL1 is energized to permit the counter slide 30 to start its downward movement and the counter slide 32 to start its upward movement. In the manner as described above, the counter slides 30, 32 are reciprocated between their upper and lower stroke ends until the STOP switch 170 or the limit switch LS4 is operated. It is noted that the one-shot multivibrators 179, 188 and 190 generate pulse signals of a given pulse width upon rise of the respective input signals.

During repetitive reciprocating movements of the counter slides 30, 32 as discussed above, the limit switch LS5 is held ON only while the counter slides 30 and 32 are moving relative to each other, as illustrated in a timing chart of FIG. 22, and an IN-FEED signal S5 is applied to an AND gate 194 while the limit switch LS5 is ON. The AND gate 194 is held open due to a signal representing the set state of the set-reset type flip-flop 174, whereby the IN-FEED signal S5 is fed to the solenoid SL3 via the AND gate 194 and a driver circuit 196. As a result, the solenoid SL3 is energized at time intervals corresponding to energization periods of the limit switch SL5, and the blank 56 is intermittently fed by intermittent activation of the hydraulic cylinder 82 in response to the IN-FEED signals S5. In this arrangement, the in-feeding movement of the blank 56 is temporarily stopped upon a temporary stop of its rolling movement after its first rolling in one direction and after its second rolling in the reverse direction. This means that the blank 56 is not fed while the flat dies 52, 54 on the counter slides 30, 32 are substantially at a stop, and thus the blank 56 is protected from otherwise possible development of die marks or scratches on the rolling surfaces due to friction with the rolling faces of the dies 52, 54.

As described hitherto, the blank 56 is bidirectionally rolled while it is axially fed in an intermittent fashion, with a result of formation of teeth on the periphery of the blank 56. When the predetermined in-feeding distance of the blank 56 is reached, the limit switch LS4 is activated and a CLEAR signal S4 is applied to respective clear terminals of the set-reset type flip-flop 174 and T-type flip-flop 178, whereby these flip-flops 174, 178 are placed in their reset state, and the signals representing the their reset state are fed from an inverter 198 to the solenoid SL4 via the driver circuit 200. Thus, the hydraulic cylinder 82 is actuated in a direction that causes the blank 56 to be pulled back from between the flat dies 52, 54. At the same time, the signal from the T-type flip-flop 178 to represent its reset state is applied to the solenoid SL2 via the driver circuit 186, and the counter slides 30, 32 are returned to their original rest positions. In this condition, an operator-controlled switch (not shown) is turned on so that the piston rod of the cylinder 96 is pulled in and the piston rod of the cylinder 102 is pushed out. Thus, the rolled blank 56, i.e., a product, is unclamped from the centers 78 and 92 and placed on the work rest 100. The rolled blank 56 on the work rest 100 is replaced by the operator with a new blank, which is then rolled in the same manner as discussed above.

Figure 24:
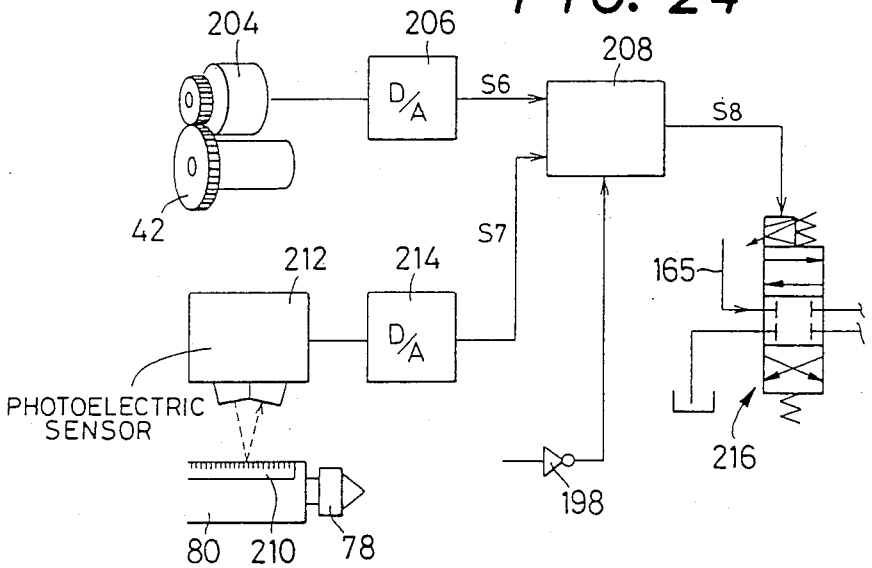
FIG. 24 is a schematic diagram illustrating an essential part of a control circuit used in still another embodiment of the invention.

While the in-feeding force or speed of the blank 56 is held constant in the above described embodiment, it is appreciated to replace the arrangement of FIGS. 21, 23 using the limit switch LS5 and the WORK DRIVE control valve 156, with an arrangement illustrated in FIG. 24, so that the in-feeding force or speed is changed according to the velocity of relative reciprocating movements of the counter slides 30, 32. This alternative arrangement of FIG. 24 comprises a pulse encoder 204 which is held in engagement with the timing gear 42 to synchronize the counter slides 30 and 32. The pulse encoder 204 generates pulses the number of which corresponds to the relative movement velocity of the counter slides 30, 32, that is, of the flat dies 52, 54. These pulse signals are fed to a D/A converter 206 which converts the pulse signals into an analog DIE VELOCITY signal S6, voltage or current signal representative of the relative movement velocity of the dies 52, 54. The DIE VELOCITY signal S6 is applied to a hydraulic servo controller 208. On the other hand, the in-feed slide 80 is provided with a displacement sensing scale plate 210 having fine graduations spaced apart in a suitable increment in the direction of movement of the in-feed slide 80. Those graduations on the plate 210 are detected by a stationary reflection-type photoelectric sensor 212 which generates pulses the number of which corresponds to the in-feeding rate of the in-feed slide 80. These pulse signals are fed to a D/A converter 214 which converts the pulse signals into an analog IN-FEED VELOCITY signal S7, voltage or current signal indicative of the in-feeding rate of the in-feed slide 80. The IN-FEED VELOCITY signal S7 is also applied to the hydraulic servo controller 208. Thus, the pulse encoder 204 and D/A converter 206 constitute a speed sensor to detect the velocity of the flat dies 52, 54, while on the other hand the scale plate 210, photoelectric sensor 212 and D/A converter 214 constitute a speed sensor to detect the in-feeding rate of the in-feed slide 80, i.e., the speed of pushing the blank 56 between the dies.

The servo controller 208 applies to a WORK DRIVE control valve 216 an OPERATION signal S8 which corresponds to a given ratio in absolute value of the DIE VELOCITY signal S6 to the IN-FEED VELOCITY signal S7. When the servo controller 208 receives the signal representing the reset state of the set-reset type flip-flop 174, the servo controller 208 provides the WORK DRIVE control valve 216 with the OPERATION signal S8 so as to apply the line pressure to the second port 160 of the hydraulic cylinder 82 and to cause the line pressure to be released through the first port 156. The WORK DRIVE control valve 216 is a well known hydraulic servo valve which serves to provide the first port 158 of the cylinder 82 with a fluid flow or pressure in proportional relation to an input signal (OPERATION signal S8).

Figure 25:
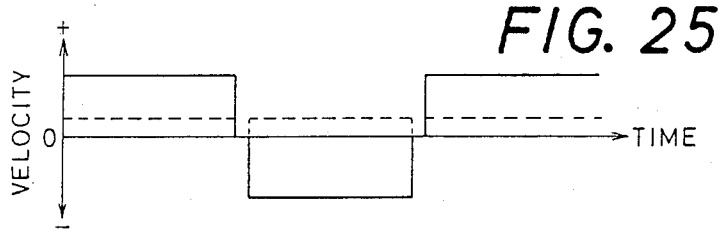
FIG. 25 is a diagrammatic representation showing an operation of the embodiment of FIG. 24.
Figure 26:
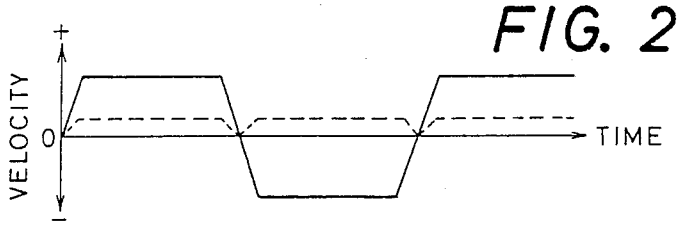
FIGS. 26 and 27 are similar diagrammatic representations showing operations of further embodiments of the invention, respectively.
Figure 27:
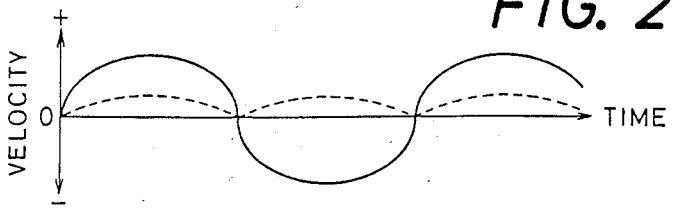

In the present embodiment, the blank 56 is fed at a rate (or with a pushing force) which is a predetermined proportion of a reciprocating velocity of the counter slide 30, 32, as shown in FIG. 25 wherein solid lines represent the reciprocating velocity and broken lines represent the in-feeding rate. This way of determination of the in-feeding rate is also applicable when the counter slide 30, 32 is driven at relative reciprocating velocities as shown in solid lines in FIGS. 26 and 27, that is, the in-feeding rate or force of the blank 56 is determined in a predetermined proportion with respect to the relative velocity of the counter slide 30, 32.

As discussed hereinbefore, the present embodiment comprising the control means permits a control of the in-feeding rate or force of the blank 56 as a function of the velocity of the relative movement of the counter slides 30, 32. Thus, the possibility of die marks or scratches or scores on the rolled surface of the blank 56 is significantly minimized, and the service life of the flat dies 52, 54 is considerably increased. While the reciprocating velocity and the in-feeding rate are represented by the solid and broken lines, respectively, in FIGS. 25–27, it is to be understood that these lines are drawn for easier understanding of the subject matter of this embodiment, and that they do not give a precise representation of a practically used proportion between the counter slide velocity and the in-feeding rate.

Figure 28:
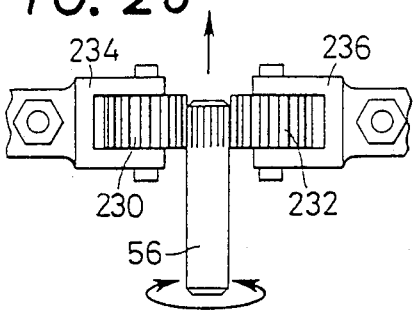
FIG. 28 is a fragmentary view showing a part of a still further embodiment of the invention wherein cylindrical or roller dies are used.

A further embodiment of a rolling apparatus of the invention is illustrated in FIG. 28, wherein a pair of cylindrical or roller type dies 230, 232 are used in place of the flat dies 52, 54 used in the preceding embodiments. The cylindrical dies 230, 232 are supported by respective die holders 234 and 236, rotatably about their axes parallel to each other. Each of the cylindrical dies 230, 232 has on its periphery a rolling face of a tooth profile corresponding to teeth to be generated on the blank 56. The blank 56 is supported rotatably by a work supporting device (not shown) similar to that used in the previous embodiments. The blank 56 is rolled bidirectionally, first in one of opposite directions and subsequently in the other direction, by rotating the dies 230, 232 and/or the blank 56 itself with a driving device not shown, and at the same time feeding the blank 56 through the dies 230, 232 in pressed rolling engagement with the rolling faces of the dies. According to this embodiment wherein the blank 56 is rolled on the rolling faces of the dies 230, 232 in the opposite directions, each of the teeth to be generated on the blank 56 is formed symmetrically in cross sectional shape in a plane across the length of the blank 56, and its lead error is appreciably reduced. In this cylindrical-die rolling apparatus, it is possible that the axis of one die be stationary and the axis of the other die be adapted to move toward the stationary die to press the blank 56 against the stationary die. It is further possible to use three cylindrical dies which are disposed to surround and press the blank 56. It is also possible that the blank 56 be stationary and the axes of the cylindrical dies 230, 232 be rotated along the circumference of the stationary blank 56 in pressed rolling engagement with the periphery of the blank 56. In summary, the major feature of the invention resides in relative bidirectional rolling of the blank 56 on rolling faces of dies, and in concurrent feeding of the blank 56 between the dies.

While the preceding embodiment of the reciprocating type rolling apparatus uses two flat dies 52, 54 which are both movable, i.e., reciprocated in opposite directions, it is possible that one of the flat dies 52, 54 is stationary while the other is reciprocated to roll a blank bidirectionally on the rolling faces of the dies. In this instance, however, a device to support and feed the blank must be moved longitudinally of the flat dies as the axis of the blank is moved.

Further, the guide rods 72, 74 for guiding the in-feed slide 80 used in the preceding embodiment may be replaced by horizontal columnar slides similar to the slide columns 14, 16. Also, the hydraulic cylinder 82 to drive the in-feed slide 80 may be disposed on the connecting plate 76 or other members so that its rod is concentric with the axis of the revolving center 78.

It is apparent that the invention may be applicable to a hot-rolling operation as well as a cold-rolling operation.

Having described the present invention, it is to be understood that the foregoing description is provided only for the purpose of illustrating preferred embodiments of the invention, and that various changes may be made in the invention without departing the spirit and scope thereof.

What is claimed is:

1. A rolling apparatus of flat-die type for rolling a cylindrical blank to generate plural teeth on the periphery of the blank, said apparatus comprising:

a pair of flat dies having shaped rolling faces comprising a plurality of straight teeth running parallel to the width of said rolling faces, said teeth having a profile corresponding to the tooth form of the teeth to be generated on the cylindrical blank, said flat dies being disposed opposite to each other in a manner which permits movement relative to and in parallel to each other, with a distance therebetween selected to permit the cylindrical blank to be brought into pressed rolling engagement with said rolling faces of the flat dies, wherein each of said pair of flat dies comprises a roll-on part located adjacent to one edge of the rolling face thereof on the blank-incoming side of the flat die as viewed in a plane along the width of said rolling face, said roll-on part of said teeth having both top lands at the crests of said teeth and bottom lands between the crests of said teeth inclined with respect to an axis of said cylindrical blank so as to reduce the distance between said rolling faces in a direction in which said blank is fed, the angle of inclination of each said top land being greater than the angle of inclination of each said bottom land;

a work supporting device for supporting the blank rotatably about its axis such that said axis is perpendicular to the lines of movement of said flat dies and parallel to the planes of said rolling faces, said work supporting device being movable in a direction parallel to said axis of the blank;

a work in-feeding device for driving said work supporting device to feed the blank axially and push the same between said dies for axially progressive rolling engagement thereof with said rolling faces; and a flat-die reciprocating device for reciprocating said flat dies relative to each other in opposite directions to roll the blank bidirectionally on said rolling faces of the flat dies in pressed rolling engagement with said rolling faces.

2. A rolling apparatus as set forth in claim 1, wherein each of said pair of flat dies comprises a roll-off part located adjacent to one edge of its rolling face on a blank-outgoing side of the flat die as viewed in a plane along the width of said rolling face, said roll-off part having a top land inclined with respect to the axis of the blank so as to increase a distance between said rolling faces in a direction in which said blank is fed.

3. A rolling apparatus as set forth in claim 1, wherein said rolling face of each of said flat dies has a length 0.5 to 3 times as much as the circumference of an outside circle of teeth to be generated on the periphery of the blank.

4. A rolling apparatus of flat-die type for rolling a cylindrical blank to generate plural teeth on the periphery of the blank, said apparatus comprising:

a pair of flat dies having shaped rolling faces comprising a plurality of straight teeth running parallel to the width of said rolling faces, said teeth having a profile corresponding to the tooth form of the teeth to be generated on the cylindrical blank, said flat dies being disposed opposite to each other in a manner which permits movement relative to and in parallel to each other, with a distance therebetween selected to permit the cylindrical blank to be brought into pressed rolling engagement with said rolling faces of the flat dies, wherein each of said pair of flat dies comprises a roll-on part located adjacent to one edge of on the blank-incoming side of the flat die as viewed in a plane along the width of said rolling face, said roll-on part having a top land which is rounded to a predetermined arc radius and a bottom land which is rounded to a predetermined arc radius smaller than that of said top land;

a work supporting device for supporting the blank rotatably about its axis such that said axis is perpendicular to the lines of movement of said flat dies and parallel to the planes of said rolling faces, said work supporting device being movable in a direction parallel to said axis of the blank;

a work in-feeding-device for driving said work supporting device to feed the blank axially and push the same between said dies for axially progressive rolling engagement thereof with said rolling faces; and a flat-die reciprocating device for reciprocating said flat dies relative to each other in opposite directions to roll the blank bidirectionally on said rolling faces of the flat dies in pressed rolling engagement with said rolling faces.

* * * * *